US009186572B2

(12) United States Patent
Baker

(10) Patent No.: US 9,186,572 B2
(45) Date of Patent: Nov. 17, 2015

(54) GEOGRAPHIC ORIGIN OF A MUSIC GAME

(71) Applicant: Jason Armstrong Baker, Ellicott City, MD (US)

(72) Inventor: Jason Armstrong Baker, Ellicott City, MD (US)

( * ) Notice: Subject to any disclaimer, the term of this patent is extended or adjusted under 35 U.S.C. 154(b) by 0 days.

(21) Appl. No.: 14/029,991

(22) Filed: Sep. 18, 2013

(65) Prior Publication Data

US 2014/0077455 A1 Mar. 20, 2014

Related U.S. Application Data

(60) Provisional application No. 61/702,410, filed on Sep. 18, 2012.

(51) Int. Cl.

| | |
|---|---|
| ***A63F 9/18*** | (2006.01) |
| ***A63F 3/04*** | (2006.01) |
| *A63F 9/24* | (2006.01) |

(52) U.S. Cl.

CPC ..... *A63F 3/0434* (2013.01); *A63F 2003/0442* (2013.01); *A63F 2009/247* (2013.01)

(58) Field of Classification Search

CPC ..... A63F 9/18; A63F 2009/18; A63F 3/04; A63F 3/0434

USPC ..... 273/429–432; 434/130, 150, 308, 319, 434/322

See application file for complete search history.

(56) References Cited

U.S. PATENT DOCUMENTS

| | | | | | |
|---|---|---|---|---|---|
| 1,346,826 | A | * | 7/1920 | Huggins | 273/254 |
| 2,043,482 | A | * | 6/1936 | Lord | 273/257 |
| 4,169,601 | A | * | 10/1979 | Frischmann et al. | 273/269 |
| 4,372,554 | A | * | 2/1983 | Orenstein | 273/430 |
| 4,643,429 | A | * | 2/1987 | Crandon et al. | 273/251 |
| 4,736,954 | A | * | 4/1988 | Haney et al. | 273/236 |
| 4,819,539 | A | * | 4/1989 | Searing | 84/476 |
| 4,928,967 | A | * | 5/1990 | Woodliff | 273/254 |
| 4,961,582 | A | * | 10/1990 | Van Lysel | 273/254 |
| 4,988,108 | A | * | 1/1991 | Shepard | 273/254 |
| 5,009,430 | A | * | 4/1991 | Yuhasz | 273/255 |
| 5,085,439 | A | * | 2/1992 | Lott | 273/236 |
| 5,106,097 | A | * | 4/1992 | Levine | 273/237 |
| 5,364,108 | A | * | 11/1994 | Esnouf | 463/9 |
| 5,690,336 | A | * | 11/1997 | Oliver | 273/302 |
| 5,755,442 | A | * | 5/1998 | Cudd | 273/256 |
| 5,931,677 | A | | 8/1999 | Rifat et al. | |
| 5,945,985 | A | | 8/1999 | Babin et al. | |
| 6,102,398 | A | * | 8/2000 | Kolleth | 273/252 |
| 6,497,412 | B1 | | 12/2002 | Bramm | |
| 7,121,549 | B2 | * | 10/2006 | Levine | 273/254 |

(Continued)

*Primary Examiner* — William Pierce

(74) *Attorney, Agent, or Firm* — Edell, Shapiro & Finnan, LLC

(57) ABSTRACT

A board game is provided that relates to identifying music and associating the music with the geographic region. The board game comprises one or more map game pieces that show geographic regions of the world. The board game also has an audio storage medium that is configured to store a plurality of music tracks from various geographic regions depicted on the map game pieces, wherein the geographic regions comprise continents, subregions of continents and countries around the world. The board game further comprises a legend game piece that provides a list of the names of the continents, subregions of continents and countries shown on the map game pieces. An instruction manual is also provided for the board game. The instruction manual comprises an answer key that lists the association of the plurality of music tracks on the audio storage medium with the various continents, subregions of continents and countries.

22 Claims, 6 Drawing Sheets

(56) References Cited

U.S. PATENT DOCUMENTS

| | | | | |
|---|---|---|---|---|
| 7,520,508 | B2 * | 4/2009 | Redd | 273/257 |
| 7,549,645 | B1 | 6/2009 | Wong | |
| 8,292,712 | B2 | 10/2012 | Nathan et al. | |
| 8,382,567 | B2 * | 2/2013 | MacIver et al. | 463/9 |
| 2003/0162160 | A1 | 8/2003 | Horchler et al. | |
| 2004/0160004 | A1 * | 8/2004 | Levine | 273/254 |
| 2008/0032276 | A1 | 2/2008 | Zheng | |
| 2011/0062664 | A1 * | 3/2011 | Royce | 273/254 |
| 2013/0309638 | A1 * | 11/2013 | Self | 434/150 |

* cited by examiner

104

NORTH AMERICA

Canada and
The United States

Native American

Arctic/ Sub- Arctic
Northeast
Northwest
Plains
Southwest

1700 – 1850

Appalachian
Civil War Songs
Creole
Cajun
Revolutionary War Songs
Spirituals

1850 – 1950

Chicago Blues
Cowboy music
Gospel
Jazz
Mississippi Delta Blues
Ragtime
Sousa Marches

THE CARIBBEAN

Anglophone (English)

Antigua and Barbuda
Bahamas
Barbados
Belize
Cayman Islands
Grenada
Guyana
Jamaica
Montserrat
Suriname (Dutch)
Trinidad and Tobago Francophone (French)

Dominica
French Guiana
Guadeloupe
Martinique
Saint-Barthélemy
Saint Kitts & Nevis
Saint Lucia
Saint Martin
Saint Vincent &
the Grenadines
Haiti Hispanophone (Spanish)

Cuba
Dominican Republic
Puerto Rico

LATIN AMERICA

Northern

Mexico

Central

Costa Rica
El Salvador
Guatemala
Honduras
Nicaragua
Panama

Southern

Argentina
Bolivia
Brazil
Chile
Colombia
Ecuador
Paraguay
Peru
Uruguay
Venezuela

NORTH AFRICA & THE MIDDLE EAST

Arabian Peninsula

Bahrain
Kuwait
Oman
Qatar
Saudi Arabia
United Arab Emirates
Yemen

Near East

Armenia
Azerbaijan
Georgia
Iran
Turkey

Eastern Mediterranean &
Mesopotamia

Jordan
Lebanon

Palestine:
-West Bank/ Gaza Strip
Iraq
Israel
Syria

North Africa

Algeria
Egypt
Libya
Tunisia
Mauritania
Morocco
Western Sahara

AFRICA

Central Africa

Angola
Burundi
Cameroon
Central African Republic
Chad
Democratic Republic of the
Congo
Equatorial Guinea
Gabon
Kenya
Republic of the Congo
Rwanda
São Tomé and Principe
Tanzania
Uganda East Africa Comoros
Djibouti
Eritrea
Ethiopia
Madagascar
Mauritius
North Sudan
Seychelles Islands
Somalia
South Sudan Southern Africa Botswana
Lesotho
Malawi
Mozambique
Namibia
South Africa
Swaziland
Zambia
Zimbabwe West Africa Benin
Burkina Faso
Cape Verde
Cote d'Ivoire
The Gambia
Ghana
Guinea
Guinea-Bissau
Liberia
Mali
Niger
Nigeria
Senegal
Sierra Leone
Togo

EUROPE

Baltic States

Estonia
Latvia
Lithuania

British Isles

Channel Islands
England
Ireland
Isle of Man
Scotland
Wales

Central Europe

Austria
Germany
Luxembourg
Switzerland

Eastern Europe

Belarus
Czech Republic
Hungary
Moldova
Poland
Slovakia
Romania
Russia

Nordic States

Denmark
Finland
Greenland
Iceland
Norway
Sweden

Southeast Europe

Albania
Bosnia-Herzegovina
Bulgaria
Croatia
Cyprus
Greece
Kosovo
Macedonia
Montenegro
Serbia
Slovenia Western Europe Belgium
France
Italy
Netherlands
Portugal
Spain

ASIA

Central Asia

Asiatic Russia
Kazakhstan
Kyrgyzstan
Mongolia
Tajikistan
Turkmenistan
Uzbekistan East Asia China
Japan
Korea (North and South)
Taiwan South Asia Afghanistan
Bangladesh
Bhutan
India
Maldives
Nepal
Pakistan
Sri Lanka Southeast Asia Brunei
Burma
Cambodia
East Timor
Laos
Indonesia
Malaysia
Philippines
Singapore
Thailand
Vietnam

OCEANIA

Melanesia

Australia
Fiji
New Caledonia (France)
Papua New Guinea
Solomon Islands
Vanuatu

Micronesia

Federated States of
Micronesia
Guam
Kiribati
Marshall Islands
Nauru
North Mariana Islands
Palau
Wake Islands Polynesia America Samoa
Cook Islands
Easter Islands
French Polynesia
Hawaii (USA)
New Zealand
Niue
Pitcairn Islands
Samoa
Tokelau
Tonga
Tuvalu
Wallis and Futuna

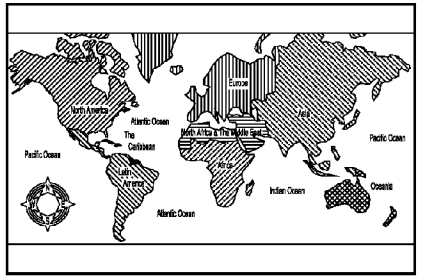

FIG.3

GEOGRAPHIC ORIGIN OF A MUSIC GAME

CROSS REFERENCE TO RELATED APPLICATIONS

This application claims priority from U.S. Provisional Application No. 61/702,410 filed on Sep. 18, 2012, the entirety of which is incorporated by reference herein.

TECHNICAL FIELD

The present disclosure relates to an interactive, audio identification game.

BACKGROUND

Music from around the world is gaining in popularity. As world music becomes more common place, it may become desirable for individuals to recognize the country or region of origin of various music styles. Additionally, business, scientific, artistic and humanitarian projects now commonly require collaboration from multiple individuals and organizations that may be located in many different parts of the world. Thus, it is important for individuals to have an increased awareness for different cultures, including a geographical awareness to identify and locate of various countries in the world and a cultural awareness to identify idiosyncratic and artistic characteristics of different countries and world regions. It is desirable to enable individuals to gain this awareness through entertaining and educational interactions, such as an interactive and competitive game. The game would enable individuals to learn about, and be tested on, geographic and cultural knowledge of different world regions. Additionally, the game would enable young children and students to enhance their geographic aptitude in alignment with national and local educational standards.

BRIEF DESCRIPTION OF THE DRAWINGS

FIG. 3 shows an example representation of the legend that lists the various regions and countries of the world.

DETAILED DESCRIPTION

Overview

Techniques are described herein for participating, facilitating and scoring a music identification game. In one embodiment, the music identification commences by a first team receiving an audio output from a music player. The audio output is classified in one or more hierarchical categories. An indication is received as to whether or not the classifying is correct. If the classifying is correct, a location on a map game piece is marked. The location on the map corresponds to information related to the one or more hierarchical categories.

In another embodiment, audio output is played from a music player. A classification of the audio output is received from a first team. The classification is in one or more hierarchical categories. The classification is evaluated and a determination is made as to whether the classification is correct. If the classification is correct, a scored point is awarded to the first team. If the classification is incorrect, an opportunity is provided to a second team to correctly classify the audio output.

In yet another embodiment, a board game is provided that relates to identifying music and associating the music with the geographic region. The board game comprises one or more map game pieces that show geographic regions of the world. The board game also has an audio storage medium that is configured to store a plurality of music tracks from various geographic regions depicted on the map game pieces, wherein the geographic regions comprise continents, subregions of continents and countries around the world. The board game further comprises a legend game piece that provides a list of the names of the continents, subregions of continents and countries shown on the map game pieces. An instruction manual is also provided for the board game. The instruction manual comprises an answer key that lists the association of the plurality of music tracks on the audio storage medium with the various continents, subregions of continents and countries.

Example Embodiments

Figure 1:
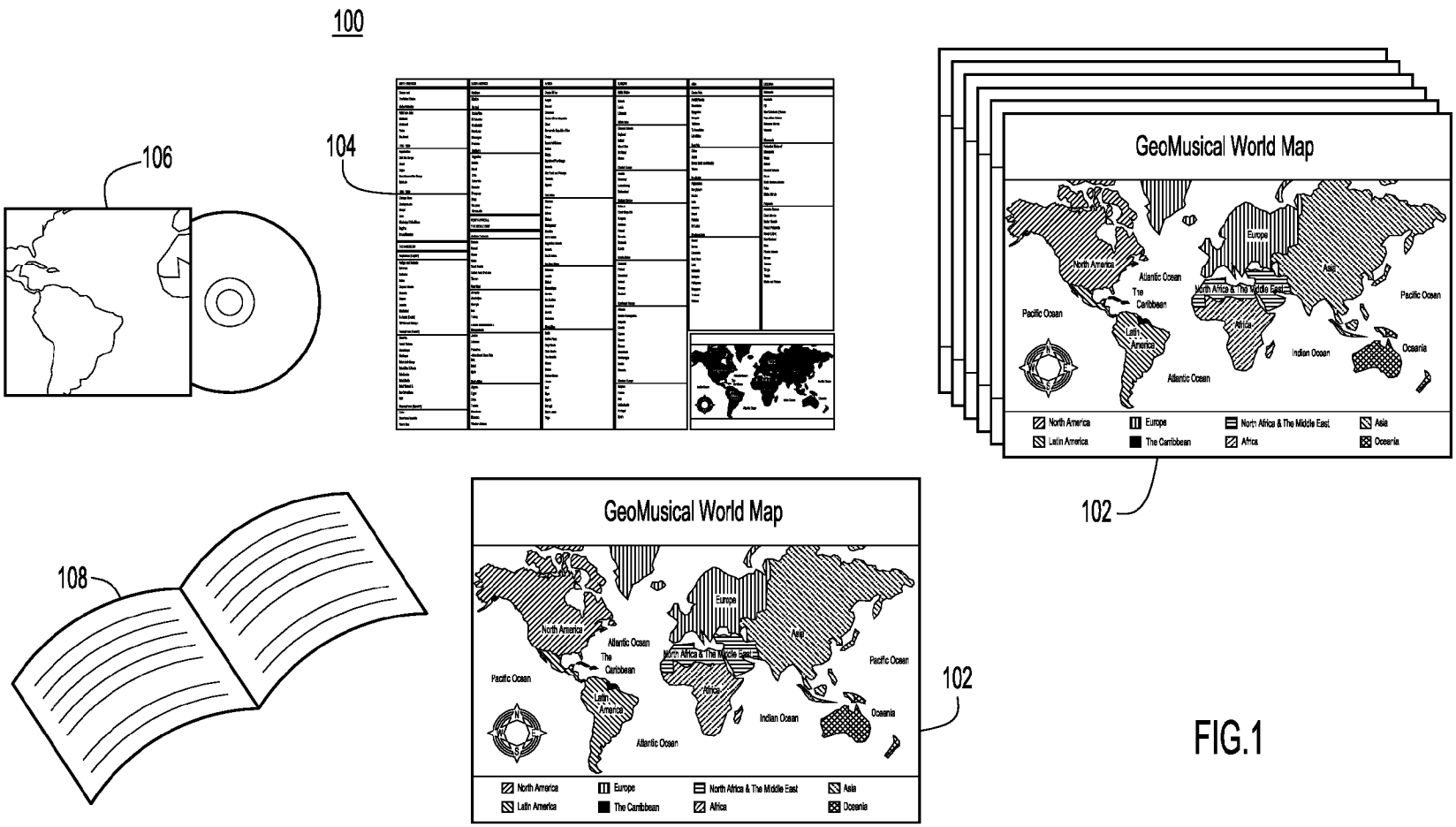
FIG. 1 is an example representation of a music identification game comprising a plurality of world maps, a legend, an audio storage medium and an instruction manual.

Reference is first made to FIG. 1. FIG. 1 shows an example representation of components of a music identification game 100. The music identification game is also referred to hereinafter as "music game" or simply "game." The music identification game comprises a plurality of world maps, shown at reference numeral 102, a legend, shown at reference numeral 104, an audio storage medium, shown at reference numeral 106 and an instruction manual, shown at reference numeral 108. The components of the music identification game 100 shown in FIG. 1 are merely an example, and it should be appreciated that there may be more components or alternative components in various versions of the game 100. In one example, the world maps 102 may be color coded, with different regions around the world highlighted in different colors. The legend 104 lists all of the countries depicted on the map, and also maps the countries to specific subregions and continents, as will become apparent herein. The audio storage medium 106 is shown in FIG. 1 as a compact disc, though it should be appreciated that it may be any storage medium that is configured to store a plurality of music tracks (e.g., tracks with music from various regions and countries around the world). The plurality of music tracks may be of the same duration or may vary from track to track. In one example, there may be thirty-five music tracks on the audio storage medium 106, each of which may correspond to a country and may be one minute in length. It should be appreciated that this is merely an example.

The instruction manual ("instructions" or "manual") 108 details how the music identification game 100 is played. For example, the manual 108 may comprise the game objectives and instructions, and additionally may comprise an answer key for classifications submitted by teams participating in the game. In one example, as will become apparent herein, a team may classify an audio track as belonging to a continent, subregion and/or country, and the answer key will contain the correct response. These features are described in more detail herein. The manual 108 may also comprise pre-tests and post-tests to be administered for game participants (e.g., students) to test geographic and cultural acumen before and after participating in the game 100. These tests can be used to track learning progress of the game participants.

In general, the game 100 involves one facilitator and two or more teams. In one example, the facilitator is an individual who is independent from each of the teams, and his or her responsibilities may involve moderating and scoring the teams' participation in the game 100. Each team may have one or more players, and during game play, scored points ("points") may be awarded to each team based on their performance. At the end of one or more rounds, a team with the highest point total is declared the winner. In one example, each team may also have a team leader or captain. The team leader/captain is the representative of the team and is responsible for delivering responses to the facilitator.

The objective of the game 100 is for the teams to correctly identify the geographic origins of a musical selection. For example, an audio output (e.g., a music track) is played, and teams are compelled to classify the music track into one or more hierarchical categories. The hierarchical categories may, for example, be related to geographic origins of the music. A first hierarchical category constitutes a continent from which the music style of the music track originates, a second hierarchical category constitutes a subregion in the content from which the music style originates and a third hierarchical category constitutes a country in the subregion from which the music style originates.

Teams earn points by correctly identifying the geographic origins of a musical selection in one of three categories by continent (Level 1), subregion (Level 2) and country (Level 3). The team with the most points after a round or predetermined number of rounds wins. In general, the facilitator may organize the teams, or players may select the teams themselves. When a musical selection is played, and when it is a team's turn, the members of the team may collaborate with one another to determine a response classification for the musical selection. The team members may then provide their answer to the facilitator through their designated team leader/captain. The facilitator determines whether or not the classification is correct, and if so, awards the appropriate number of points to the team that answered correctly.

The team may classify the musical selection into the one or more of the hierarchical categories, as appropriate. For example, during one round, teams may only be required to supply a Level 1 classification, while in other rounds, the teams may be required to classify the musical selection in one or more additional hierarchical categories (e.g., Level 2 and Level 3). In one version of game play, the game 100 can be played at increasing levels of difficulty (wherein Level 1 is the easiest level and Level 3 is the hardest level). At Level 1, teams may be required to identify only the continent of origin of the music selection. At Level 2, students may be required to answer both the Level 1 question and the Level 2 (subregion) question. At Level 3, students may be required to first identify the origin of the played selection by continent, then subregion and final country or countries. At all levels, any music selection may be played for a predetermined period of time (e.g., one minute).

When the game starts, each team may be provided, for example, with three world maps 102, three playing cards (e.g., one king of any suit, one queen of any suit and one ace of any suit) and a one or more paper pads (for scoring and collaboration purposes). A first team will be selected, by chance or by choice, to participate first. The first team is then provided with a place holder object, which indicates the team's turn in the game 100. The facilitator plays an audio track from the audio storage medium 106 and asks questions of one or more of the hierarchical levels. For example, for Level 1, the facilitator might ask "Which continent does the music come from?" For Level 2, the facilitator might ask "What subregion does this music come from?" For Level 3, the facilitator might ask "What country does this music come from?" If the first team answers correctly, it wins one point and then passes the place holder to the next team. If the first team answers incorrectly, a second team has a chance to steal the point.

In the instance where the second team has a chance to steal the point, the second team will be awarded one point if it answers correctly a question that the first team could not answer (e.g., if the second team makes a proper classification, when the first team makes an improper classification). If the second team answers incorrectly, a third team receives an opportunity to steal the point, and so on. This continues until either a team answers correctly or until all teams have had a chance to answer. Once either the first team has answered the question correctly or if another team has stolen the point, the second team (or whichever team is next) now has a first chance at a new musical selection, and the placeholder is passed to that team to start the next turn.

In one embodiment, the team that answers the continent (Level 1) question correctly is informed by the facilitator of the subregion and country from which the music selection originates. In another embodiment, the team that answers the Level 1 question correctly is then asked subsequent Level 2 and Level 3 questions, with an opportunity to score additional point values for answering questions at each level. As in the case above, an incorrect response may provide other teams with the opportunity to steal the point for the particular level in which the incorrect answer was provided. The point winning team may then mark the country of origin on one of the maps 102 (or on a wall map). In one example, teams are awarded one point for each correct Level 1 and Level 2 classification and are awarded two points for each Level 3 classification.

Teams may be able to receive one or more hints from the facilitator. These hints may be requested from the facilitator at will or by a team turning in (through its team leader/captain) a hint card to the facilitator. Hint cards are, for example, the king card and queen card distributed to each team at the start of the game, and thus, in this example, each team is allowed only two hint requests. If a team decides that it needs a hint, the team leader/captain asks the facilitator for the hint and surrenders one of that team's hint cards. The facilitator supplies a hint corresponding to the question level that the team is answering.

Teams may also be able to block potential answers provided by other teams. For example, the first team may use a block (by turning in the ace card to the facilitator) to prevent team 2 from answering a subsequent question. In one example, each team may have only one blocking card. The purpose of the block is to steal the question from the team at play and to win points as a result. The block is applied against the team at play (e.g., the first team can attempt to block the second team when the second team is at play) as the team at play attempts to answer its question. For example, assuming it is the second team's turn, the first team may play its block card (e.g., by the first team leader/captain holding up the ace card) and saying "block" out loud. The first team then has a chance to answer the question, and if correct, the first team may have a chance to answer questions at other levels. In one example, if the first team answers incorrectly, points may be deducted from the first team's score. For example, after playing the block card, the first team may lose one point for an incorrect Level 1 answer, two points for an incorrect Level 2 answer and three points for an incorrect Level 3 answer. Thus, teams may use the block card, but at their own peril should they answer incorrectly.

Once a complete round has been played (e.g., when all teams have a turn to answer questions), the facilitator adds up all the points. The team with the most points wins. Optionally, a game may consist of two or more rounds. During gameplay, team members are encouraged to listen to the music in silence, to consider the music's sound and feel, imagine where the music comes from, discuss possible answer choices by listening to each other, choose the team's best possible answer, answer through a team leader/captain and identify a place on the map.

Figure 2:
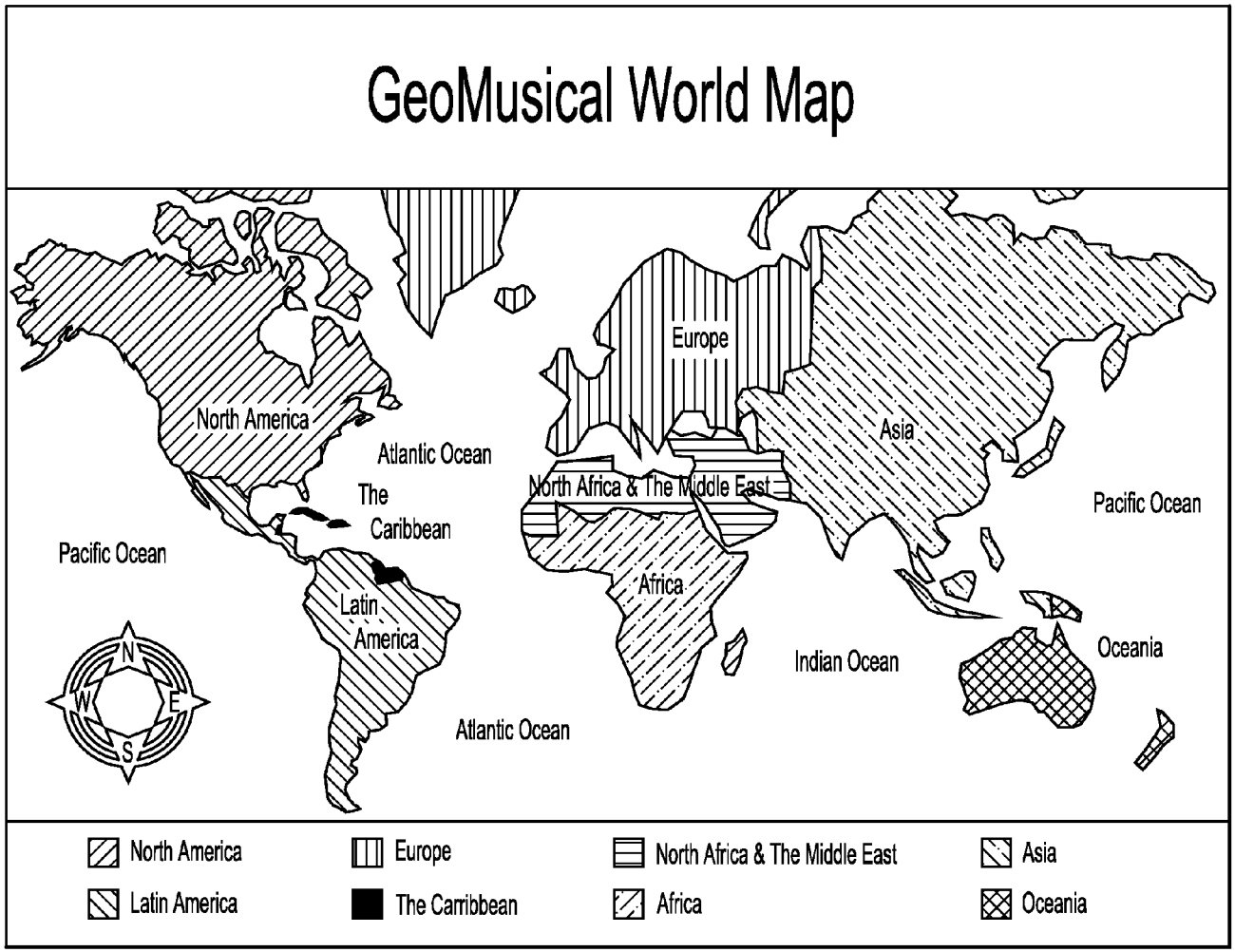
FIG. 2 shows an example representation of the world map of the music identification game.
Figure 4:
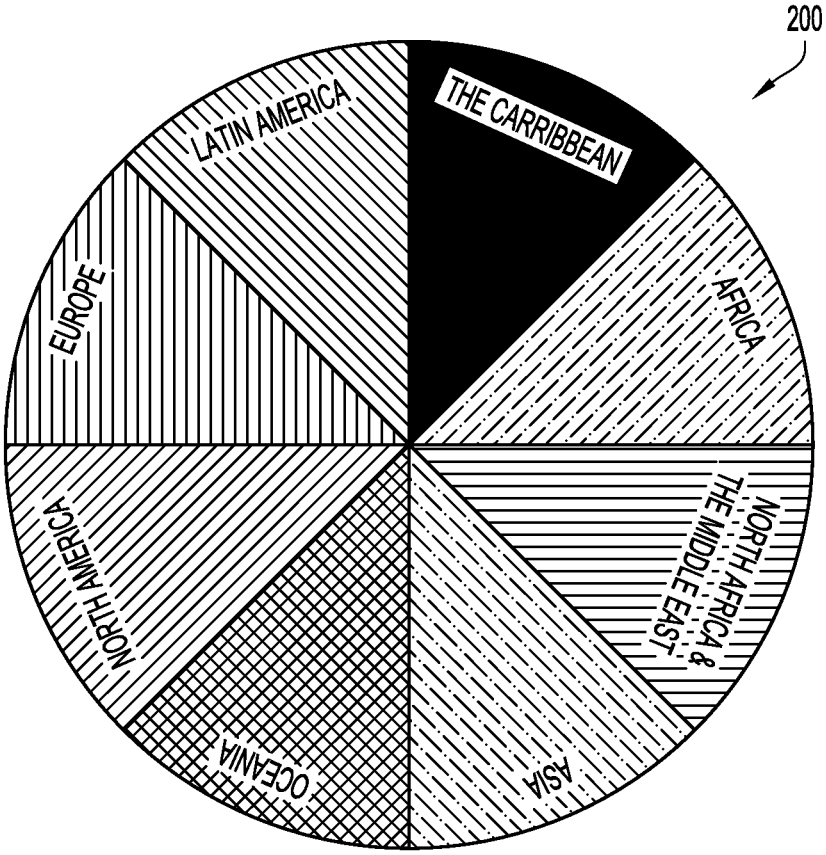
FIG. 4 shows an example representation of a place holder object used as a part of the music identification game.

Referring to FIG. 2, an example word map 102 is shown. The world map 102 in FIG. 2 shows various continents, though it should be appreciated that more detailed maps may be included as a part of the game 100 that include the subregions and countries. FIG. 3 shows an example legend 104 that may be provided with the game. The legend 104 in FIG. 3 lists all of the countries in particular continents and subregions within continents. FIG. 4 shows an example placeholder 200 that is used to indicate a team's turn during the game 100. The place holder may have a list of continents, as shown in FIG. 4.

Figure 5:
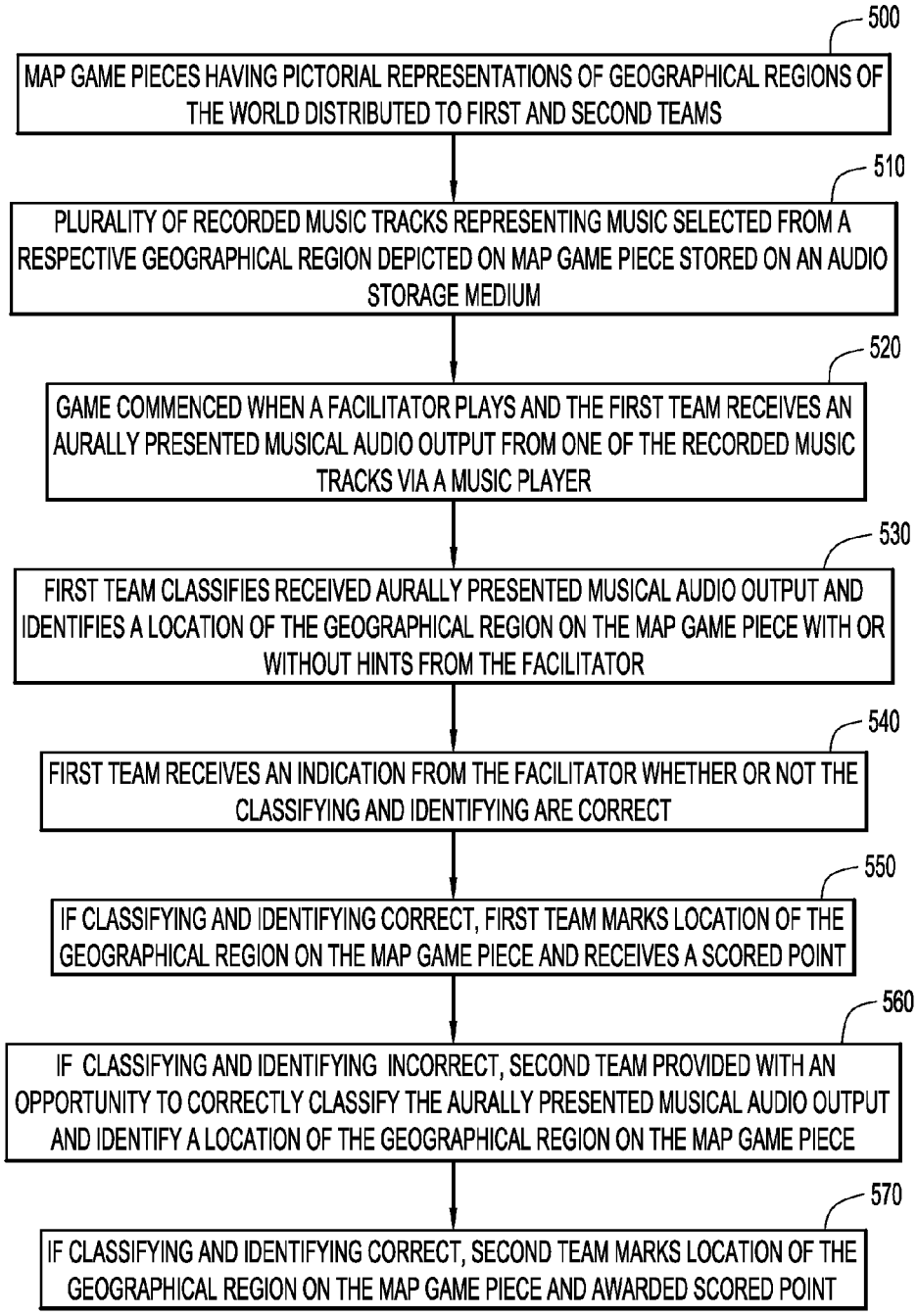
FIG. 5 is a flow chart illustrating the steps of playing the music identification game in accordance with an embodiment of the present invention.
Figure 6:
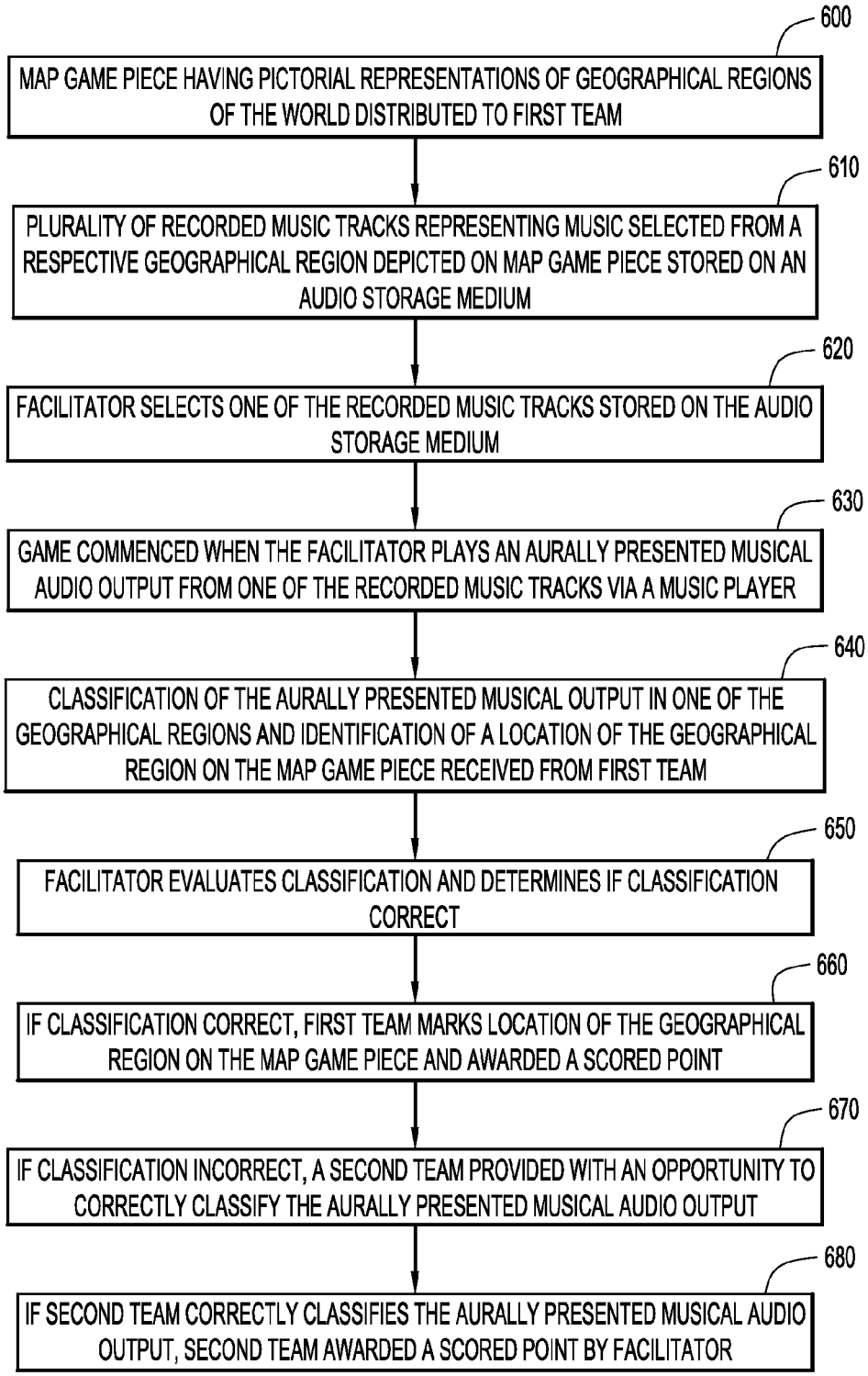
FIG. 6 is a flow chart illustrating the steps of playing the music identification game in accordance with another embodiment of the present invention.

The music identification game described above may be reduced into a number of steps illustrated in the flow charts of FIGS. 5 and 6. Referring to FIG. 5, map game pieces having pictorial representations of geographical regions of the world are distributed to a first and second team (step 500). A plurality of recorded music tracks representing music selected from a respective geographical region depicted on the map game piece is stored on an audio storage medium (step 510). The game is commenced when a facilitator plays and the first team receives an aurally presented musical audio output from one of the recorded music tracks via a music player (step 520). Upon receiving the aurally presented musical output, the first team classifies the aurally presented musical audio output and identifies a location of the geographical region on the map game piece (step 530). However, the first team may request one or more hints from the facilitator before classifying the aurally presented musical audio output and identifying a location of the geographical region on the map game piece. Next, the first team receives an indication from the facilitator whether or not the classifying and identifying are correct (step 540) and, if correct, the first team marks a location of the geographical region on the map game piece and receives a scored point (step 550). If the classifying and identifying are incorrect, the second team is provided with an opportunity to correctly classify the aurally presented musical audio output and identify a location of the geographical region on the map game piece (step 560). If the classifying and identifying are correct, the second team marks a location of the geographical region on the map game piece and is awarded a scored point (step 570).

Referring to FIG. 6, a map game piece having pictorial representations of geographical regions of the world is distributed to a first team (step 600). A plurality of recorded music tracks representing music selected from a respective geographical region depicted on the map game piece is stored on an audio storage medium (step 610). At step 620, a facilitator selects one of the recorded music tracks stored on the audio storage medium. The game is commenced when the facilitator plays an aurally presented musical audio output from one of the recorded music tracks via a music player (step 630). At step 640, classification of the aurally presented musical output in one of the geographical regions and identification of a location of the geographical region on the map game piece is received from the first team. Next, the facilitator evaluates the classification and determines if the classification is correct (step 650). If the classification is correct, the first team marks a location of the geographical region on the map game piece and is awarded a scored point (step 660). If the classification is incorrect, a second team is provided with an opportunity to correctly classify the aurally presented musical audio output (step 670). If the second team correctly classifies the aurally presented musical audio output, the second team is awarded a scored point by the facilitator (step 680).

The game 100 instructs participants in several important skill areas. In addition to teaching and testing the participants on geographic knowledge, the game 100 teaches several decision making lessons. For example, team leaders/captains may be instructed to make one or more of consensus decisions, democratic decisions and dictatorship. Consensus decisions require every team member to work through the process to provide an answer. Democratic decisions require a majority of team members to select an answer. Dictatorship decisions require the team leader/captain to make the final decision (with or without the agreement of the team).

Furthermore, the game 100 is an important educational supplement for several core educational standards in geography. For example, lessons from the game 100 may be demonstrative of several core national geography standards and other state and local educational standards (e.g., Common Core standards).

Additional variations to the game may be provided where pictures of musical instruments on playing cards are provided as a part of the scoring system. For example, twelve cards may be turned upside down, each of which has a picture of a musical instrument. Each musical instrument may be on exactly two cards, and thus, teams may turn over two cards to determine if there is a matching instrument. If so, the team may score a point, and a facilitator or teacher may play that instrument for entertainment. If the cards do not match, a team may turn the card back to its upside down state and another team may have a chance to attempt a match. Points may be scored to each team that obtains a match.

In sum, a method for participating in a music identification game is provided, comprising: commencing the music identification game by a first team receiving an audio output from a music player; classifying the audio output in one or more hierarchical categories; receiving an indication as to whether or not the classifying is correct; if the classifying is correct, marking a location on a map game piece, wherein the location on the map corresponds to information related to the one or more hierarchical categories; if the classifying is incorrect, providing an opportunity to a second team to correctly classify the audio output.

In addition, a method of facilitating a music identification game is provided, comprising: playing an audio output from a music player; receiving from a first team a classification of the audio output in one or more hierarchical categories; evaluating the classification and determining if the classification is correct; if the classification is correct, awarding a scored point to the first team; if the classification is incorrect, providing an opportunity to a second team to correctly classify the audio output.

Furthermore, a board game relating to identifying music and associating the music with a geographic region is provided. The board game, in combination, comprises: one or more map game pieces that show geographic regions of the world; an audio storage medium that is configured to store a plurality of music tracks from various geographic regions depicted on the map game pieces, wherein the geographic regions comprise continents, subregions of continents and countries around the world; a legend game piece that provides a list of the names of the continents, subregions of continents and countries shown on the map game pieces; and an instruction manual that provides instructions for the board game and that comprises an answer key that lists the association of the plurality of music tracks on the audio storage medium with the various continents, subregions of continents and countries.

The above description is intended by way of example only. Various modifications and structural changes may be made therein without departing from the scope of the concepts described herein and within the scope and range of equivalents of the claims.

What is claimed is:

1. A method for teaching geography to one or more persons on at least a first team and a second team by having said one or more persons identify a geographic region of origin of aurally presented music in a music-integrated geography game environment, comprising:

distributing at least one map game piece to at least the first and second teams, wherein the at least one map game piece has a map surface displaying pictorial representations of geographical regions of the world;

storing on an audio storage medium a plurality of recorded music tracks, wherein each recorded music track represents music selected from a respective one of the geographical regions depicted on the surface of the at least one map game piece;

commencing the music-integrated geography game of identifying the geographic region of origin by a facilitator playing and the first team receiving an aurally presented musical audio output from at least one of the recorded music tracks representing music from one of the geographical regions depicted on the surface of the at least one map game piece via a music player configured to play the recorded music tracks stored on said audio storage medium;

the first team, upon receiving the aurally presented musical audio output, classifying the aurally presented musical audio output in one of the geographical regions depicted on the surface of the at least one map game piece and, thereafter, identifying a location of the geographical region on the surface of the at least one map game piece to reinforce geographical awareness and retention of the region's location in the world;

receiving an indication from the facilitator as to whether or not the classifying and identifying are correct;

if the classifying and identifying are correct, the first team marking the identified location on the surface of the at least one map game piece distributed to the first team, wherein the marked location on the surface of the at least one map game piece distributed to the first team corresponds to information related to said one geographical region depicted on the surface of the at least one map game piece; and if the classifying and identifying are incorrect, providing an opportunity to the second team to correctly classify the aurally presented musical audio output, identify a location of the geographical region on the surface of the at least one map game piece distributed to the second team, and mark the identified location on the surface of the at least one map game piece distributed to the second team, wherein the marked location on the surface of the at least one map game piece distributed to the second team corresponds to information related to said one geographical region depicted on the surface of the at least one map game piece.

2. The method of claim 1, wherein commencing comprises commencing the game of identifying a geographic region of origin by the first team receiving the aurally presented musical audio output that is a musical song associated with one of the geographical regions depicted on the surface of the at least one map game piece.

3. The method of claim 1, wherein classifying comprises classifying the aurally presented musical audio output in a first hierarchical category that identifies a continent associated with the aurally presented musical audio output, a second hierarchical category that identifies a subregion on the continent that is associated with the aurally presented musical audio output, and a third hierarchical category that identifies a country in the subregion that is associated with the aurally presented musical audio output.

4. The method of claim 3, further comprising receiving from the facilitator a scored point to the first team if the classifying is correct.

5. The method of claim 4, wherein receiving the scored point comprises receiving a first point value if the classifying of the first hierarchical category is correct, receiving a second point value if the classifying of the second hierarchical category is correct, and receiving a third point value if the classifying of the third hierarchical category is correct.

6. The method of claim 1, further comprising receiving a hint indication at the request of the first team, wherein the hint indication comprises information that further assists classification of the aurally presented musical audio output in one of the geographical regions depicted on the surface of the at least one map game piece.

7. The method of claim 1, wherein marking comprises marking on the surface of the map game piece a country that is associated with the aurally presented musical audio output.

8. The method of claim 1, further comprising providing to the first team an opportunity to classify the aurally presented musical audio output before the second team has an opportunity to classify the aurally presented musical audio output.

9. The method of claim 1, wherein commencing comprises commencing the game of identifying a geographic region of origin when the aurally presented musical audio output is received via the music player configured to play a compact disc containing multiple recorded music tracks representing music from the geographical regions depicted on the surface of the at least one map game piece.

10. The method of claim 1, wherein commencing comprises commencing the game of identifying a geographic region of origin when the aurally presented musical audio output is received via an application accessible by a mobile device by one or more persons of the first team and one or more persons of the second team.

11. The method of claim 1, wherein classifying comprises classifying the aurally presented musical audio output within a predetermined time period.

12. A method for teaching geography to one or more persons on a first team by having said one or more persons identify a geographic region of origin of aurally presented music in a music-integrated geography game environment, comprising:

distributing at least one map game piece to the first team, wherein the at least one map game piece has a map surface displaying pictorial representations of geographical regions of the world;

storing on an audio storage medium a plurality of recorded music tracks, wherein each recorded music track represents music selected from a respective one of the geographical regions depicted on the surface of the at least one map game piece;

selecting by a facilitator at least one of the recorded music tracks stored on said audio storage medium;

commencing the music-integrated geography game of identifying a geographic region of origin by the facilitator playing an aurally presented musical audio output from the selected recorded music track via a music player configured to play the recorded music tracks stored on said audio storage medium;

receiving from the first team a classification of the aurally presented musical audio output in one of the geographical regions depicted on the surface of the at least one map game piece, wherein said classification includes identifying a location of the geographical region on the surface of the at least one map game piece to reinforce geographical awareness and retention of the region's location in the world;

evaluating by the facilitator the classification and determining if the classification is correct;

if the classification is correct, marking on the surface of the at least one map game piece the identified geographic region of origin associated with the aurally presented musical audio output and awarding by the facilitator a scored point to the first team;

if the classification is incorrect, providing an opportunity to one or more persons of a second team to correctly classify the aurally presented musical audio output; and if the second team correctly classifies the aurally presented musical audio output, awarding by the facilitator a scored point to the second team.

13. The method of claim 12, wherein playing comprises playing the aurally presented musical audio output via the music player configured to play a compact disc containing multiple recorded music tracks representing music from the geographical regions depicted on the surface of the at least one map game piece.

14. The method of claim 12, wherein playing comprises playing the aurally presented musical audio output via the music player that operates as an application accessible by a mobile device by one or more persons of the first team and one or more persons of the second team.

15. The method of claim 12, wherein receiving comprises receiving the classification of the aurally presented musical audio output in a first hierarchical category that identifies a continent associated with the aurally presented musical audio output, a second hierarchical category that identifies a subregion of the continent that is associated with the aurally presented musical audio output, and a third hierarchical category that identifies a country in the subregion that is associated with the aurally presented musical audio output.

16. The method of claim 15, wherein awarding comprises awarding a first point value to the first team if the classification of a first hierarchical category is correct, awarding a second point value to the first team if the classification of a second hierarchical category is correct and awarding a third point value to the first team if the classification of a third hierarchical category is correct.

17. The method of claim 12, wherein marking comprises marking on the surface of the map game piece a country that is associated with the aurally presented musical audio output.

18. A board game relating to teaching geography by having game participants identify a geographic region of origin of aurally presented music in a music-integrated geography game environment, comprising:

one or more map game pieces, each game piece having a map surface displaying pictorial representations of geographic regions of the world, the geographic regions including continents, subregions of continents, and countries around the world;

an audio storage medium that is configured to store a plurality of recorded music tracks, wherein each recorded music track represents music from one of the continents, subregions of continents, and countries around the world depicted on the surface of the one or more map game pieces;

a legend game piece that provides a list of the names of the continents, subregions of continents, and countries displayed on the surface of the one or more map game pieces; and an instruction manual that provides instructions for the music-integrated geography board game and includes an answer key that lists the association of the plurality of recorded music tracks on the audio storage medium with the various continents, subregions of continents, and countries around the world depicted on the surface of the one or more map game pieces, wherein the instruction manual further includes pre-tests and post-tests comprising questions pertaining to the geographic regions depicted on the surface of the one or more map game pieces, the pre-tests to be administered to the game participants prior to commencing the music-integrated geography game to determine geographical and cultural knowledge, and the post-tests to be administered to the game participants upon conclusion of the music-integrated geography game to determine the game participants' geographic and cultural learning progress.

19. The board game of claim 18, wherein the audio storage medium is a compact disc containing multiple recorded music tracks that are configured to be played by a music player, wherein the recorded music tracks represent music from the continents, subregions of continents, and countries around the world depicted on the surface of the one or more map game pieces.

20. The board game of claim 19, wherein the recorded music tracks are configured to play for a fixed duration of time music that represents the continents, subregions of continents, and countries around the world depicted on the surface of the one or more map game pieces.

21. The method of claim 1, further comprising:

prior to commencing the game, administering to the one or more persons on at least said first and second teams a test to determine geographic and cultural knowledge; and upon conclusion of the game, administering to the one or more persons on at least said first and second teams a test to determine geographic and cultural learning progress.

22. The method of claim 12, further comprising:

prior to commencing the game, administering to the one or more persons on said first team a test to determine geographic and cultural knowledge; and upon conclusion of the game, administering to the one or more persons on said first team a test to determine geographic and cultural learning progress.

* * * * *